US009190782B2

(12) United States Patent
King et al.

(10) Patent No.: US 9,190,782 B2
(45) Date of Patent: Nov. 17, 2015

(54) POWER CONNECTION SYSTEM

(71) Applicant: Club Car, LLC, Evans, GA (US)

(72) Inventors: Russell W. King, Evans, GA (US); Dave Neal Schult, N. Augusta, SC (US)

(73) Assignee: Club Car, LLC, Evans, GA (US)

( * ) Notice: Subject to any disclaimer, the term of this patent is extended or adjusted under 35 U.S.C. 154(b) by 107 days.

(21) Appl. No.: 13/873,659

(22) Filed: Apr. 30, 2013

(65) Prior Publication Data

US 2013/0337673 A1 Dec. 19, 2013

Related U.S. Application Data

(60) Provisional application No. 61/640,348, filed on Apr. 30, 2012.

(51) Int. Cl.
*H01R 13/713* (2006.01)
*H01R 13/635* (2006.01)
*H01R 13/703* (2006.01)

(52) U.S. Cl.
CPC ..... *H01R 13/713* (2013.01); *H01R 13/635* (2013.01); *H01R 13/7037* (2013.01)

(58) Field of Classification Search
CPC ..... H01R 13/7037
USPC ..... 439/38, 39
See application file for complete search history.

(56) References Cited

U.S. PATENT DOCUMENTS 2,573,920 A * 11/1951 McLeod ..... 200/51.09
3,521,216 A * 7/1970 Jerair ..... 439/39
4,242,657 A * 12/1980 Chaillot ..... 335/207
4,317,969 A * 3/1982 Riegler et al. ..... 200/52 R
4,451,113 A * 5/1984 Zuniga ..... 439/40
4,491,792 A * 1/1985 Bullock et al. ..... 324/157
5,202,617 A 4/1993 Nor
5,385,480 A 1/1995 Hoffman
5,921,783 A * 7/1999 Fritsch et al. ..... 439/38
6,114,833 A 9/2000 Langston et al.
6,157,162 A 12/2000 Hayashi et al.

(Continued)

OTHER PUBLICATIONS

SAE International Technical Report, Surface Vehicle Recommended Practice, SAE Electric Vehicle and Plug in Hybrid Electric Vehicle Conductive Charge Coupler, J1772 Jan. 2010, Superseding J1772 Nov. 2001, Issued Oct. 1996, revised Jan. 2010, 51 pages.

(Continued)

*Primary Examiner* — Ross Gushi
(74) *Attorney, Agent, or Firm* — Taft Stettinius & Hollister LLP

(57) ABSTRACT

An AC cord/plug is "dead" while disconnected and goes "live" only when connected. The plug has a set of spring-loaded, normally-open contacts, each having two sets of fixed contacts and a single set of movable contacts. The movable contacts are in a spring-loaded assembly that has an iron core opposite the contacts, and the fixed contacts are in a hermetically sealed compartment shielding them from the plug's exterior. The AC plug inputs (L1, L2) are connected to one set of the normally open, fixed contacts, and the plug's socket terminals are connected to the other set of normally opened, fixed contacts. In the unplugged state, the plug's socket contacts are electrically isolated from the L1 and L2 inputs. When plugged-in, the plug's socket terminals go "live" when a magnetic circuit closes between the plug and socket that causes the plug's spring-loaded assembly to move to close the contacts.

12 Claims, 3 Drawing Sheets

(56) References Cited

U.S. PATENT DOCUMENTS

| | | | | |
|---|---|---|---|---|
| 6,183,264 | B1 * | 2/2001 | Harsanyi | 439/38 |
| 6,225,776 | B1 | 5/2001 | Chai | |
| 6,231,349 | B1 * | 5/2001 | Bullinger et al. | 439/39 |
| 6,561,815 | B1 * | 5/2003 | Schmidt | 439/38 |
| 6,966,781 | B1 * | 11/2005 | Bullinger et al. | 439/38 |
| 7,467,948 | B2 * | 12/2008 | Lindberg et al. | 439/38 |
| 7,637,746 | B2 * | 12/2009 | Lindberg et al. | 439/38 |
| 7,871,272 | B2 * | 1/2011 | Firman et al. | 439/34 |
| 7,936,242 | B2 * | 5/2011 | Carpenter | 335/205 |
| 8,314,669 | B2 * | 11/2012 | Botsch | 335/177 |
| 8,454,372 | B2 * | 6/2013 | Lee et al. | 439/38 |
| 2002/0154461 | A1 * | 10/2002 | Chapman et al. | 361/42 |
| 2004/0169489 | A1 | 9/2004 | Hobbs | |
| 2007/0149013 | A1 * | 6/2007 | Eastham et al. | 439/140 |
| 2007/0278991 | A1 | 12/2007 | Miyata | |
| 2007/0287302 | A1 * | 12/2007 | Lindberg et al. | 439/38 |
| 2009/0111287 | A1 * | 4/2009 | Lindberg et al. | 439/39 |
| 2010/0320964 | A1 | 12/2010 | Lathrop et al. | |
| 2011/0074351 | A1 | 3/2011 | Bianco et al. | |
| 2011/0077809 | A1 | 3/2011 | Leary | |
| 2011/0193667 | A1 * | 8/2011 | Botsch | 335/219 |
| 2012/0282786 | A1 * | 11/2012 | Neel | 439/39 |
| 2012/0309210 | A1 * | 12/2012 | Lee et al. | 439/39 |
| 2013/0012037 | A1 * | 1/2013 | Enomoto et al. | 439/39 |
| 2013/0181671 | A1 | 7/2013 | King | |
| 2013/0295781 | A1 * | 11/2013 | Gualino et al. | 439/39 |
| 2013/0337673 | A1 * | 12/2013 | King et al. | 439/188 |
| 2014/0120745 | A1 * | 5/2014 | Wang et al. | 439/39 |
| 2014/0162468 | A1 * | 6/2014 | Kim | 439/39 |
| 2014/0287602 | A1 * | 9/2014 | Pons Gonzalez | 439/39 |
| 2014/0302691 | A1 * | 10/2014 | Janfada et al. | 439/39 |

OTHER PUBLICATIONS

FCI MVL Division, Brochure, POWER.S3, EV-PLUG-16/32A, Charge plug 16/32A as per SAE-J1772 & IEC-62196-2-1, 2010, 34 pages.

International Search Report and Written Opinion, PCT/US2012/072302 dated Mar. 7, 2013; 7 pages.

* cited by examiner

POWER CONNECTION SYSTEM

The present invention relates to electric vehicles, generally, and more particularly to the power connections for recharging electric vehicles.

BACKGROUND OF THE INVENTION

Common to all electric vehicles is their need to have their traction battery packs recharged after use. The term "plug-in" in describing electric vehicles speaks directly to this universal requirement. This invention addresses the manner in which electric vehicles are plugged in for recharging. To enable an electric vehicle to replenish the traction battery system, the vehicle must be connected to a power source. For "plug-ins," this typically involves connecting the power cord to an AC electrical service. During this power connection process, the user must grasp a live AC cord/plug set in order to make this connection, but there is an inherent safety risk when one grasps a live cord/plug set, especially in wet conditions.

SUMMARY OF THE INVENTION

The present invention provides a means for the AC cord/plug set to be "dead" or "isolated" electronically while in the disconnected state and to become "live" only in the connected state. The invention thus focuses on a plug and a receptacle that enables charging power to be connected safely to an electric vehicle. The plug of the present invention contains a set of spring-loaded, normally-open contacts comprising two sets of fixed contacts and a single set of movable contacts. The movable contacts are part of a spring-loaded assembly with an iron core at an end of the assembly opposite from the contacts. This assembly and the fixed contacts are contained within a hermetically sealed compartment within the assembly to provide isolation of the contacts from the exterior of the plug. The AC inputs (L1, L2) to the plug are connected to one set of the normally-opened, fixed contacts, while the plug socket terminals are connected to the other set of normally-opened, fixed contacts. In the normally-opened, unplugged state, the sockets are electrically isolated from the L1 and L2 inputs. In the plugged-in position, however, the socket terminals become live via completion of a magnetic circuit between the plug and the receptacle that causes the contact shuttle to move to close the electrical contacts.

The receptacle of the present invention is comprised of a set of pins that provide the means for power to be fed to the charging system when connected to the live socket terminals within the plug. The receptacle also contains a permanent magnetic that provides the magnetic field to attract the iron core of the movable contact shuttle that is within the plug. The contact shuttle and iron core are spring-loaded to keep the contacts in the normally opened state, but are free to move within the plug housing when force is applied. The contact shuttle moves as the iron core is attracted to the permanent magnet during plug-in. The movable contacts close the circuit with the fixed contacts as a result of the shuttle movement towards the magnet. This contact closure then connects the AC input to the socket terminals. This connection within the plug connects power to the vehicle for its charging. This connection is only made when the plug and receptacle come together close enough that it provides protection for the user from the live pins and sockets within the plug/receptacle connection.

Upon disconnection of the plug from the receptacle, the magnetic circuit is broken before the plug is completely free of the receptacle. At this point, the spring attached to the contact shuttle provides the force to return the shuttle to its original position where the contacts are in the normally-open state and the "live" AC is isolated from the external plug conductors.

The present invention is novel and unobvious in that the means to provide isolation of the "live" circuits are mechanical in nature as compared to more complex, electronic means for isolating "live" circuits, such as plugs made to meet the SAEj1772 standard. The present invention does not require any control signals or any logic from discrete or microprocessor-based subsystems.

DETAILED DESCRIPTION

Figure 1:
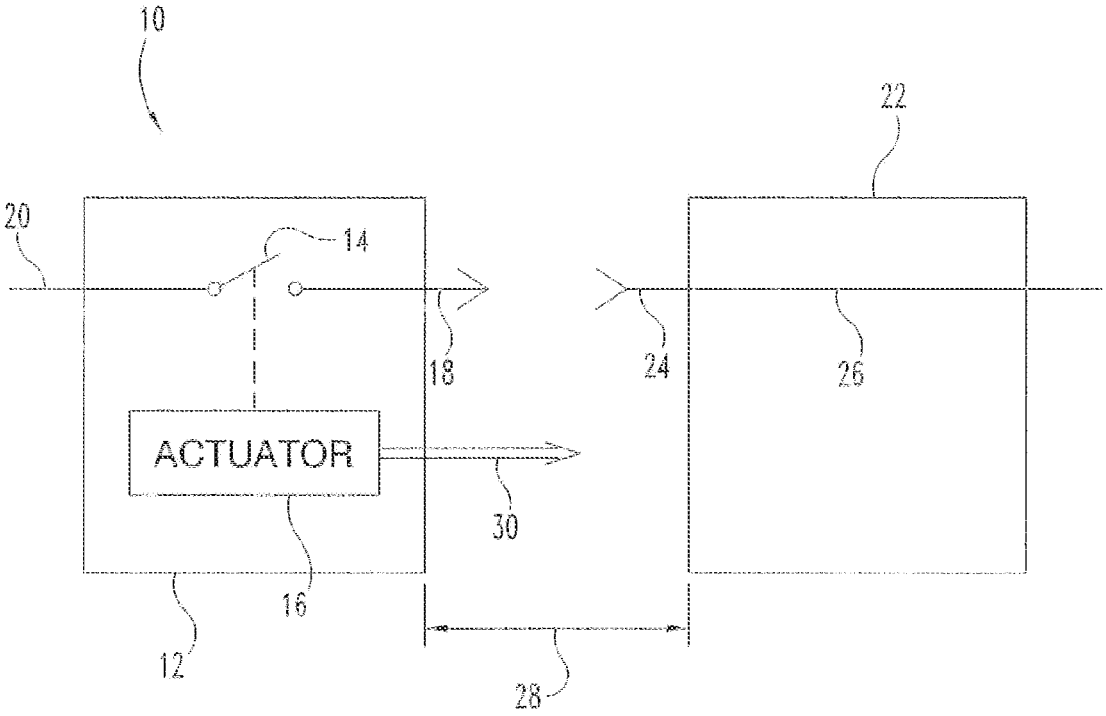
FIG. 1 is a block diagram of a connection system of the preferred embodiment.

FIG. 1 is a block diagram of a connection system according to the preferred embodiment. In this embodiment, the connection system 10 includes a first connector 12 and a second connector 22.

The first connector 12 includes a normally-open switch 14 and an actuator 16. The actuator 16 is coupled to the normally open switch 14. Connector 12 includes a contact 18 and wiring 20 coupled to the switch 14. Connector 22 includes a contact 24 coupled to wiring 26. When the connector 12 and connector 22 are mated, the contact 18 is coupled to the contact 24. Accordingly, a connection can be made between wiring 20 and 26 when the switch 14 is closed.

When the connector 12 and connector 22 are separated by less than a threshold distance 28 along the axis of insertion of the connectors 12 and 22, a force 30 between the actuator 16 and the connector 12 causes the actuator 16 to close the switch 14. As will be described in further detail below, the force 30 in the preferred embodiment is a magnetic force.

Although one switch 14 is illustrated, any number of switches 14 can be present. In the preferred embodiment, the actuator 16 can be coupled to multiple switches 14. Moreover, multiple actuators 16 can be present and coupled to multiple switches 14.

Figure 2:
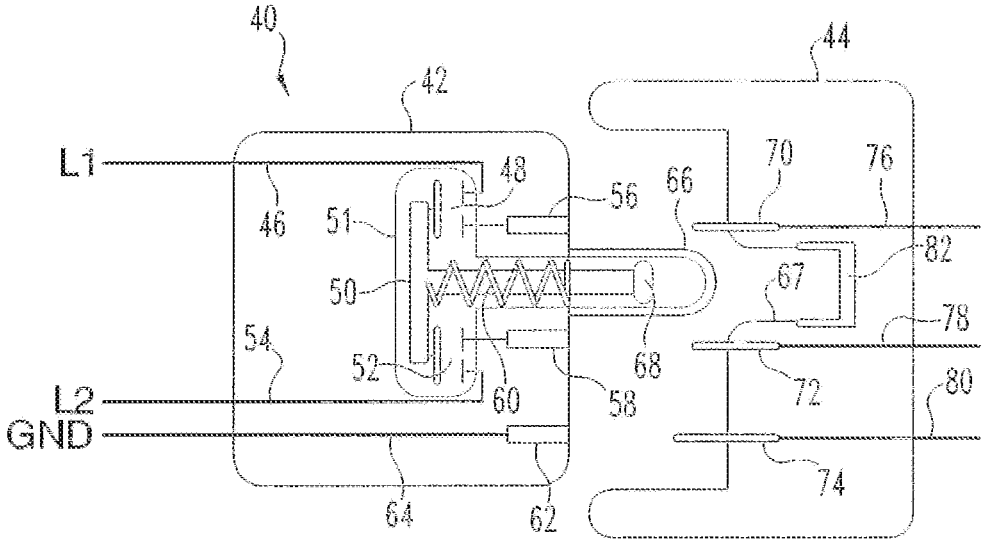
FIG. 2 is a block diagram of a connection system in a disconnected state according to the preferred embodiment.
Figure 3:
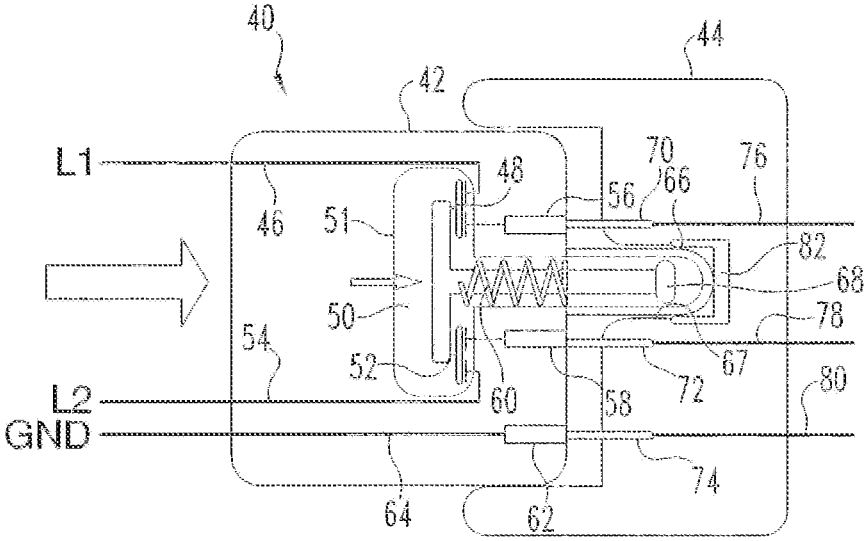
FIG. 3 is a block diagram of the connection system of FIG. 2 in a connected state.

FIG. 2 is a block diagram of a connection system in a disconnected state according to the preferred embodiment. FIG. 3 is a block diagram of the connection system of FIG. 2 in a connected state. Referring to FIGS. 2 and 3, in the preferred embodiment the connection system 40 includes a connector 42 and a connector 44. The connector 42 includes two wires 46 and 54. Each wire 46 and 54 is coupled to a corresponding switch 48 and 52, respectively. A spring 60 provides a mechanical force that causes the actuator 50 to open the switches 48 and 52. In particular, the spring 60 can apply a force to the actuator along the axis of insertion of the connector 42, such as a force in a direction away from the connector 44. Accordingly, the contacts 56 and 58 are disconnected from the wires 46 and 54 when the connector 42 is separated from the connector 44 by a threshold distance 28.

The connector 42 also includes a protrusion 66. The actuator 50 extends within the protrusion 66. The actuator 50 includes a ferromagnetic material 68, such as iron, at an end of the actuator 50. The actuator 50 and the ferromagnetic material 68 portion of the actuator 50 can move within the protrusion 66.

The connector 44 includes a socket 67 sized to receive the protrusion 66. In the preferred embodiment, a magnet 82 is disposed at the end of socket 67. The connector 44 also includes contacts 70, 72, and 74 corresponding in size to contacts 56, 58, and 62 of the connector 42.

As the connector 42 and connector 44 are mated, the protrusion 66 and its ferromagnetic material 68 approach the magnet 82. At a predefined threshold distance, the magnetic attraction between the ferromagnetic material 68 and the magnet 82 overcomes the force on the actuator 50 of the spring 60. As a result, the contacts of the switches 48 and 52 are closed. If the wires 46 and 54 are connected to a live power source, the contacts 56 and 58 of connector 42 do not become live until the threshold distance is passed. That is, the contacts 56 and 58 do not become live until the connectors 42 and 44 are close enough for the magnetic attraction force to close the switches 48 and 52.

In the preferred embodiment, the threshold distance can be greater than a separation of the connector 42 and the connector 44 when the connector 42 is mated with the connector 44. That is, the actuator 50 and magnet 82 can be disposed such that the switches 48 and 52 close before the connectors 42 and 44 are fully mated. In another preferred embodiment, the threshold distance is greater than a separation of the connector 42 and the connector 44 when a contact of the first connector 42 initially contacts a contact of the connector 44 as the connector 42 is mated with the connector 44. For example, before any contacts occur between the connectors 42 and 44, the switches 48 and 52 can be closed. In another example, some contacts can contact each other, such as ground contacts 62 and 74 before the switches 48 and 52 close, but contacts 56 and 70, and 58 and 72 may not contact each other until after the switches 48 and 52 close.

Although these particular examples have been given, the sequencing of when contact of the connectors 42 and 44 occurs, and when the switches 48 and 52 close, can be selected as desired through selection of contact length, magnet 82 strength, spring 60 force, and the like.

In the preferred embodiment, the threshold distance at which the switches 48 and 52 close can be less than a separation of the connector 42 and the connector 44 at which the housings of the connectors 42 and 44 substantially obstruct access to the contacts of the connectors 42 and 44. For example, a portion of a housing of the connector 44 can substantially surround an end of the connector 42 before the switches 48 and 52 close. As a result, the contacts 56 and 58 will not become live until access to the contacts 56 and 58 is substantially obstructed.

In another preferred embodiment, the threshold distance can be selected such that any openings exposing the contacts 56 and 58 can be smaller than a threshold size, such as a size that substantially blocks access by fingers of an operator. In another preferred embodiment, the threshold distance can be selected to be a distance at which posts, slots, tabs, or other alignment or engagement structures can be in contact. That is, the switches 48 and 52 can close after the connectors 42 and 44 have been aligned and the remaining mating action is a force to engage the connectors 42 and 44.

In the preferred embodiment, the switches 48 and 52 can be disposed in a chamber 51 of the connector 42. Accordingly, the switches 48 and 52 can be substantially isolated from a user. The chamber 51 can be substantially sealed, with ventilation for any increased pressure due to arcing when the switches 48 and 52 are opened or closed.

In the preferred embodiment, the chamber 51 is hermetically sealed. As described above, the threshold distance at which the switches 48 and 52 close can be selected such that the switches 48 and 52 close before associated contacts 56 and 58 make a power connection. Thus, any arcing that may occur would likely occur between the contacts 56, 58, 70, and 72.

Although the magnet 82 and the ferromagnetic material 68 have been described above as preferred materials in their defined positions, other combinations of materials can be used. For example, a magnet can be coupled to the actuator 50, and a ferromagnetic material 68, or an appropriately polarized magnet, can be located in the socket 67.

In another example, the magnet 82 can be polarized to repel a magnet coupled to the actuator 50. Thus, when the connectors 42 and 44 approach each other, the actuator 50 is repelled from the connector 44. The switches 48 and 52 can be structured relative to the actuator such that the repulsion of the actuator 50 causes the switches 48 and 52 to close. Furthermore, although forces along the axis of insertion have been described as acting on the actuator 50, forces in other directions can cause the actuator 50 to close the switches 48 and 52. For example, the actuator 50 can be disposed such that a force from a magnet that is perpendicular to the axis of insertion can cause the switches 48 and 52 to close.

Although switches within one connector 42 have been described, the mating connector 44 can also have switches that can close based on the proximity of the connectors 42 and 44.

Figure 4:
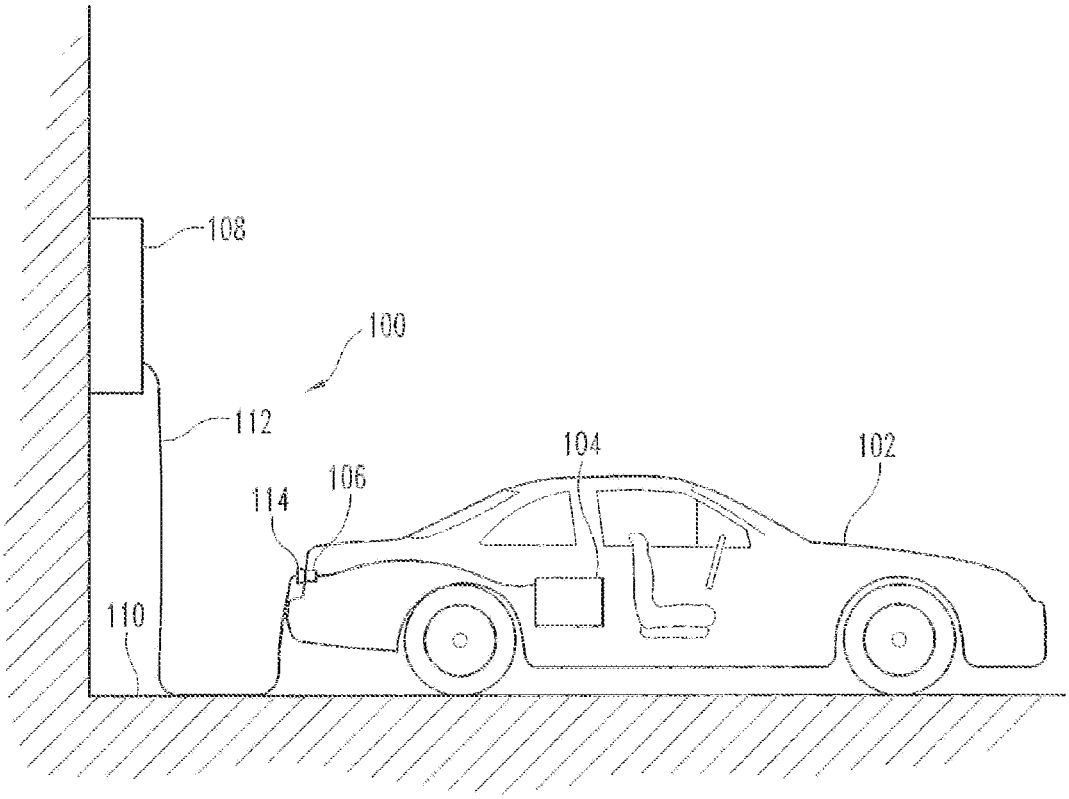
FIG. 4 is a block diagram of a vehicle charging system according to the preferred embodiment.

FIG. 4 is a block diagram of a vehicle charging system according to the preferred embodiment. The vehicle charging system 100 includes a power source 108 with a cable 112 and connector 114. The system 100 can be located within a building, garage, or other similar structure 110. The system 100 can be disposed anywhere that is accessible by the vehicle 102.

The vehicle 102 can be an electric a golf car vehicle, a utility vehicle, or a passenger vehicle, or the like. The vehicle 102 can be coupled to the power source 108 for charging an onboard battery system 104. For example, the vehicle 102 can include a battery system 104 configured to provide electrical power for the vehicle 102. Although in the preferred embodiment, the battery system 104 can be the sole source of energy for the vehicle 102, the vehicle 102 can also include other power sources, such as the internal combustion engine within a hybrid vehicle.

The power source 108 can be a power source for recharging the battery system 104 of the vehicle 102. For example, the power source 108 can be an alternating current (AC) electrical source, a direct current (DC) electrical source, or the like. In another example, the power source 108 can be a high-voltage power source.

The power source 108 and vehicle 102 can each have associated connectors 114 and 106 that are part of a connection system as described above. That is, the connector 114 can include switches that close when the connector 114 is within a threshold distance from connector 106. If the switches of the connector 114 are inline with the power supply wires from the power source 108, the contacts of connector 114 will not go live until the connector 114 is within the threshold distance.

Although preferred embodiments to date have been described above, the scope of the following claims is not limited to these described embodiments. Various modifications, changes, combinations, substitution of equivalents, or the like, can be made and still fall within the scope of the following claims.

The invention claimed is:

1. An electrical connection system, comprising:

a first connector having at least one electrical switch through which electricity will pass when the switch is closed that is operated by an actuator that leaves the electrical switch open when the actuator is not being activated; and a second connector that receives the first connector along an established axis of connection and through which electricity will pass when the first connector's electrical switch is closed;

a magnetic force that arises between the first and second connectors when they are at a defined distance apart on their axis of connection that activates the actuator in the first connector to close the electrical switch in the first connector; and a hermetically sealed chamber surrounding the at least one electrical switch through which electricity will pass when the switch is closed and the actuator that leaves the electrical switch open when the actuator is not being activated.

2. The connection system of claim 1, wherein there are two electrical switches through which electricity will pass when the switches are closed that are operated by actuators that leave the switches open when the actuators are not being activated.

3. The connection system of claim 1, and further comprising a spring configured to apply a mechanical force along the axis of connection to the actuator that leaves the electrical switch in an open position when the actuator is not being activated.

4. The connection system of claim 1, wherein the magnetic force is imparted by a ferromagnetic material in the second connector.

5. The connection system of claim 4, wherein the magnetic force is imparted by a magnet in the second connector.

6. The connection system of claim 1, wherein:

the first connector includes a protruding male portion; and the second connector includes a female socket configured to receive the protruding male portion of the first connector; and wherein the actuator of the first connector is partially disposed within the protruding male portion and wherein a magnet is disposed at the apex of the female socket within the second connector socket.

7. An electrical connection system, comprising:

a first connector having at least one electrical switch through which electricity will pass when the switch is closed that is operated by an actuator that leaves the electrical switch open when the actuator is not being activated; and a second connector that receives the first connector along an established axis of connection and through which electricity will pass when the first connector's electrical switch is closed; and a magnetic force that arises between the first and second connectors when they are at a defined distance apart on their axis of connection that activates the actuator in the first connector to close the electrical switch in the first connector; wherein:

the first connector includes a protruding male portion; and the second connector includes a female socket configured to receive the protruding male portion of the first connector; and wherein the actuator of the first connector is partially disposed within the protruding male portion and wherein a magnet is disposed at the apex of the female socket within the second connector socket.

8. The connection system of claim 7, wherein there are two electrical switches through which electricity will pass when the switches are closed that are operated by actuators that leave the switches open when the actuators are not being activated.

9. The connection system of claim 7, and further comprising a spring configured to apply a mechanical force along the axis of connection to the actuator that leaves the electrical switch in an open position when the actuator is not being activated.

10. The connection system of claim 7, wherein the magnetic force is imparted by a ferromagnetic material in the second connector.

11. The connection system of claim 10, wherein the magnetic force is imparted by a magnet in the second connector.

12. The connection system of claim 7, and further comprising a hermetically sealed chamber surrounding the at least one electrical switch through which electricity will pass when the switch is closed and the actuator that leaves the electrical switch open when the actuator is not being activated.

* * * * *